US011525242B2

(12) United States Patent
Jung et al.

(10) Patent No.: US 11,525,242 B2
(45) Date of Patent: Dec. 13, 2022

(54) CONTROL METHOD FOR CONSTRUCTION MACHINERY AND CONTROL SYSTEM FOR CONSTRUCTION MACHINERY

(71) Applicant: DOOSAN INFRACORE CO., LTD., Incheon (KR)

(72) Inventors: Wooyong Jung, Seoul (KR); Wonsun Sohn, Seoul (KR); Jaiseok Bang, Incheon (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 164 days.

(21) Appl. No.: 17/174,908

(22) Filed: Feb. 12, 2021

(65) Prior Publication Data

US 2021/0254310 A1 Aug. 19, 2021

(30) Foreign Application Priority Data

Feb. 14, 2020 (KR) ..... 10-2020-0018383

(51) Int. Cl.

| | |
|---|---|
| ***E02F 9/22*** | (2006.01) |
| ***E02F 3/43*** | (2006.01) |
| ***F04B 17/05*** | (2006.01) |
| ***F04B 49/20*** | (2006.01) |

(52) U.S. Cl.

CPC ..... *E02F 9/2246* (2013.01); *E02F 3/435* (2013.01); *E02F 9/2235* (2013.01); *E02F 9/2296* (2013.01); *F04B 17/05* (2013.01); *F04B 49/20* (2013.01)

(58) Field of Classification Search

CPC ..... E02F 3/435; E02F 3/437; E02F 9/2235; E02F 9/2246

See application file for complete search history.

(56) References Cited

U.S. PATENT DOCUMENTS

| | | | | |
|---|---|---|---|---|
| 6,170,262 | B1 | 1/2001 | Yoshimura et al. | |
| 6,308,516 | B1 | 10/2001 | Kamada | |
| 10,106,957 | B2 * | 10/2018 | Kim | E02F 9/2246 |
| 2014/0200795 | A1 | 7/2014 | Kawaguchi et al. | |

FOREIGN PATENT DOCUMENTS

| | | |
|---|---|---|
| CN | 1756899 A | 4/2006 |
| EP | 3133212 A1 | 4/2014 |

OTHER PUBLICATIONS

Chinese Office Action for related Chinese Application No. 202110181177.6; action dated Mar. 30, 2022; (5 pages).

Extended European Search Report for related European Application No. 21156445.5; action dated Jul. 7, 2021; (7 pages).

* cited by examiner

*Primary Examiner* — Michael Leslie

(74) *Attorney, Agent, or Firm* — K&L Gates LLP

(57) ABSTRACT

In a control method for construction machinery, an operation performed by the construction machinery is divided into a plurality of subordinate works. A current subordinate work currently performed by the construction machinery is determined. A maximum absorbing torque of a hydraulic pump is adjusted according to the determined subordinate work. An engine speed change map is adjusted according to the determined subordinate work.

16 Claims, 6 Drawing Sheets

CONTROL METHOD FOR CONSTRUCTION MACHINERY AND CONTROL SYSTEM FOR CONSTRUCTION MACHINERY

PRIORITY STATEMENT

This application claims priority under 35 U.S.C. § 119 to Korean Patent Application No. 10-2020-0018383, filed on Feb. 14, 2020 in the Korean Intellectual Property Office (KIPO), the contents of which are herein incorporated by reference in their entirety.

BACKGROUND

1. Field

Example embodiments relate to a control method for construction machinery and a control system for construction machinery. More particularly, example embodiments relate to a method of controlling an engine and a hydraulic pump in construction machinery such as an excavator and a control system for construction machinery for performing the same.

2. Description of the Related Art

In general, construction machinery such as an excavator may include an engine as a prime mover, and may drive at least one variable capacity hydraulic pump using the engine such that a hydraulic actuator is driven by a hydraulic oil discharged from the hydraulic pump to perform a necessary operation.

When an operator directly determines and selects a power mode of the hydraulic pump in consideration of working situations, the operator may select a power mode suitable for a maximum load condition. However, when only part of the repetitive detailed work content is in a high load area and most of the rest is in a low load area, unnecessary energy may be consumed and fuel economy may be deteriorated.

Further, in high-speed control, an engine speed profile curve that changes according to a load may be used fixedly. In this case, there is a problem in that workability and operability may be deteriorated when a work speed required by the current work changes.

SUMMARY

Example embodiments provide a control method for construction machinery capable of improving fuel efficiency and workability together.

Example embodiments provide a control system for construction machinery for performing the same.

According to example embodiments, in a control method for construction machinery, an operation performed by the construction machinery is divided into a plurality of subordinate works. A current subordinate work currently performed by the construction machinery is determined. A maximum absorbing torque of a hydraulic pump is adjusted according to the determined subordinate work. An engine speed change map is adjusted according to the determined subordinate work.

In example embodiments, adjusting the maximum absorbing torque of the hydraulic pump may include controlling the hydraulic pump to have a maximum absorbing torque that is increased or decreased by a preset ratio from an initial absorbing torque value according to a load amount of the current subordinate work.

In example embodiments, the initial absorbing torque value may be determined by a power mode selected by an operator.

In example embodiments, adjusting the maximum absorbing torque of the hydraulic pump may include controlling the hydraulic pump to have a first maximum absorbing torque that is increased by a first ratio from the initial absorbing torque value when the current subordinate work is in a high load area, and controlling the hydraulic pump to have a second maximum absorbing torque that is decreased by a second ratio from the initial absorbing torque value when the current subordinate work is in a low load area.

In example embodiments, adjusting the maximum absorbing torque of the hydraulic pump may further include controlling to have a third maximum absorbing torque that is less than the first maximum absorbing torque value and greater than the second maximum absorbing torque value when the current subordinate work is in a middle load area.

In example embodiments, adjusting the engine speed change map may include controlling an engine to have an engine speed change rate that is increased or decreased by a preset ratio from an initial engine speed change rate in high-speed control according to a required working speed of the current subordinate work.

In example embodiments, the initial engine speed change rate may be determined by a fuel dial set value preset by an operator.

In example embodiments, adjusting the engine speed change map may include controlling the engine to have a first engine speed change rate in high-speed control when the current subordinate work has a first required working speed, and controlling the engine to have a second engine speed change rate less than the first engine speed change rate in high-speed control when the current subordinate work has a second required working speed less than the first required working speed.

According to example embodiments, a control system for construction machinery is provided. The construction machinery includes an engine, a hydraulic pump driven by the engine and a control valve configured to control a flow direction of a hydraulic oil discharged from the hydraulic pump to control operations of actuators. The control system includes a controller configured to determine a current subordinate work of the construction machinery and output a pump control signal and an engine control signal according to the determined current subordinate work, a pump regulator configured to adjust a swash plate angle of the hydraulic pump to have a maximum absorbing torque corresponding to the pump control signal, and an engine control unit configured to adjust an engine rpm to have an engine speed change map corresponding to the engine control signal.

In example embodiments, the controller may control the swash plate angle of the hydraulic pump to have the maximum absorbing torque that is increased or decreased by a preset ratio from an initial absorbing torque value of the hydraulic pump according to a load amount of the current subordinate work.

In example embodiments, the initial absorbing torque value may be determined by a power mode selected by an operator.

In example embodiments, the controller may output a first pump control signal to have a first maximum absorbing torque that is increased by a first ratio from the initial absorbing torque value when the current subordinate work is in a high load area, and the controller may output a second pump control signal to have a second maximum absorbing torque that is decreased by a second ratio from the initial absorbing torque value when the current subordinate work is in a low load area.

In example embodiments, the controller may output a third pump control signal to have a third maximum absorbing torque that is less than the first maximum absorbing torque value and greater than the second maximum absorbing torque value when the current subordinate work is in a middle load area.

In example embodiments, the controller may control the engine to have an engine speed change rate that is increased or decreased by a preset ratio from an initial engine speed change rate in high-speed control according to a required working speed of the current subordinate work.

In example embodiments, the initial engine speed change rate may be determined by a fuel dial set value preset by an operator.

In example embodiments, the controller may output a first engine control signal to have a first engine speed change rate in high-speed control when the current subordinate work has a first required working speed, and the controller may output a second engine control signal to have a second engine speed change rate less than the first engine speed change rate in high-speed control when the current subordinate work has a second required working speed less than the first required working speed.

According to example embodiments, an optimized maximum absorbing torque of a hydraulic pump and an optimized engine speed change map (engine speed change rate) in high-speed control may be applied according to a current work situation (load amount, working speed). Thus, fuel economy and productivity may be improved together.

BRIEF DESCRIPTION OF THE DRAWINGS

Example embodiments will be more clearly understood from the following detailed description taken in conjunction with the accompanying drawings.

DETAILED DESCRIPTION OF EXAMPLE EMBODIMENTS

Figure 1:
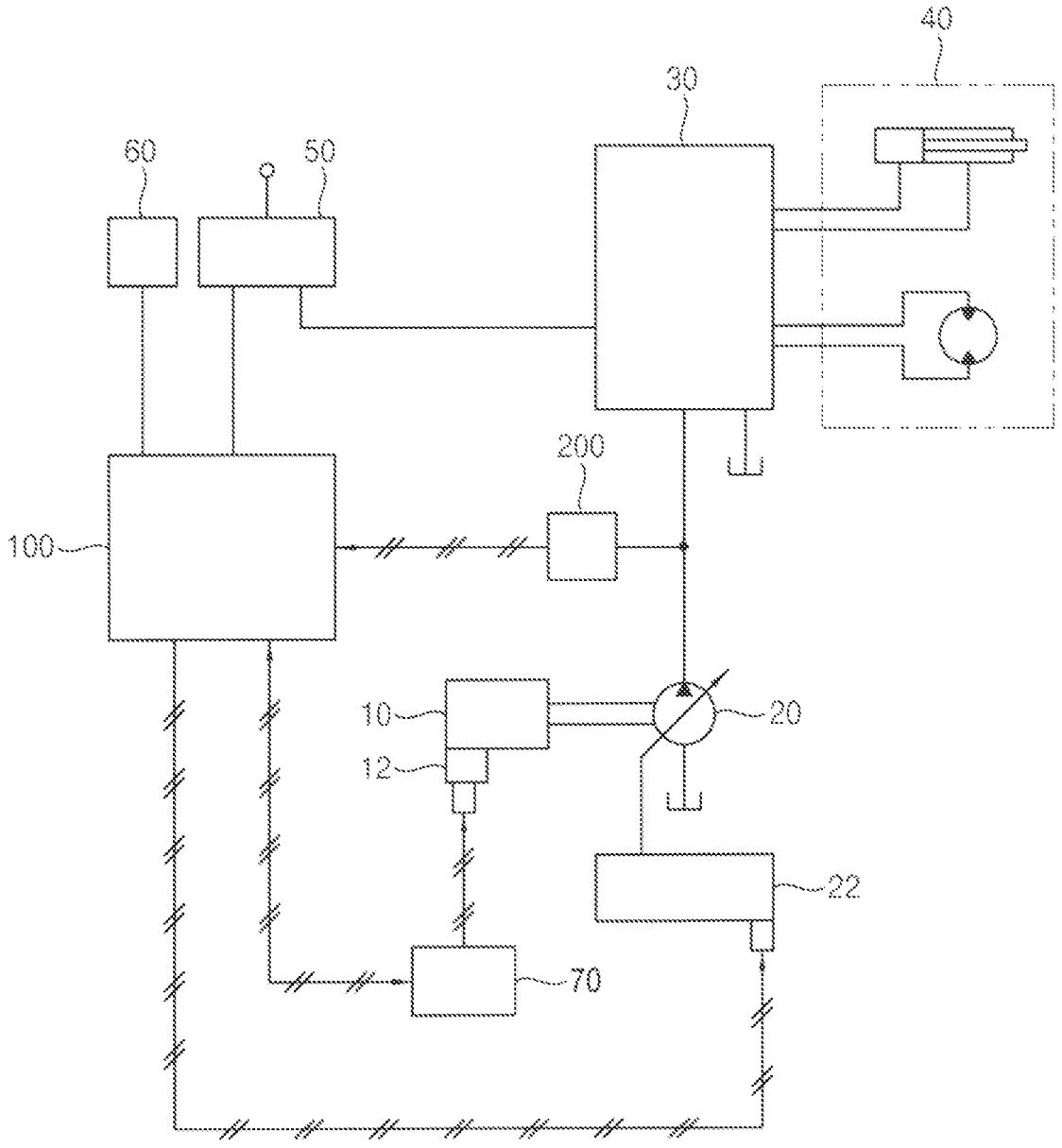
FIG. 1 is a hydraulic diagram illustrating a control system for construction machinery in accordance with example embodiments.

Hereinafter, preferable embodiments of the present invention will be explained in detail with reference to the accompanying drawings.

In the drawings, the sizes and relative sizes of components or elements may be exaggerated for clarity.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Example embodiments may, however, be embodied in many different forms and should not be construed as limited to example embodiments set forth herein. Rather, these example embodiments are provided so that this disclosure will be thorough and complete, and will fully convey the scope of example embodiments to those skilled in the art.

Figure 2:
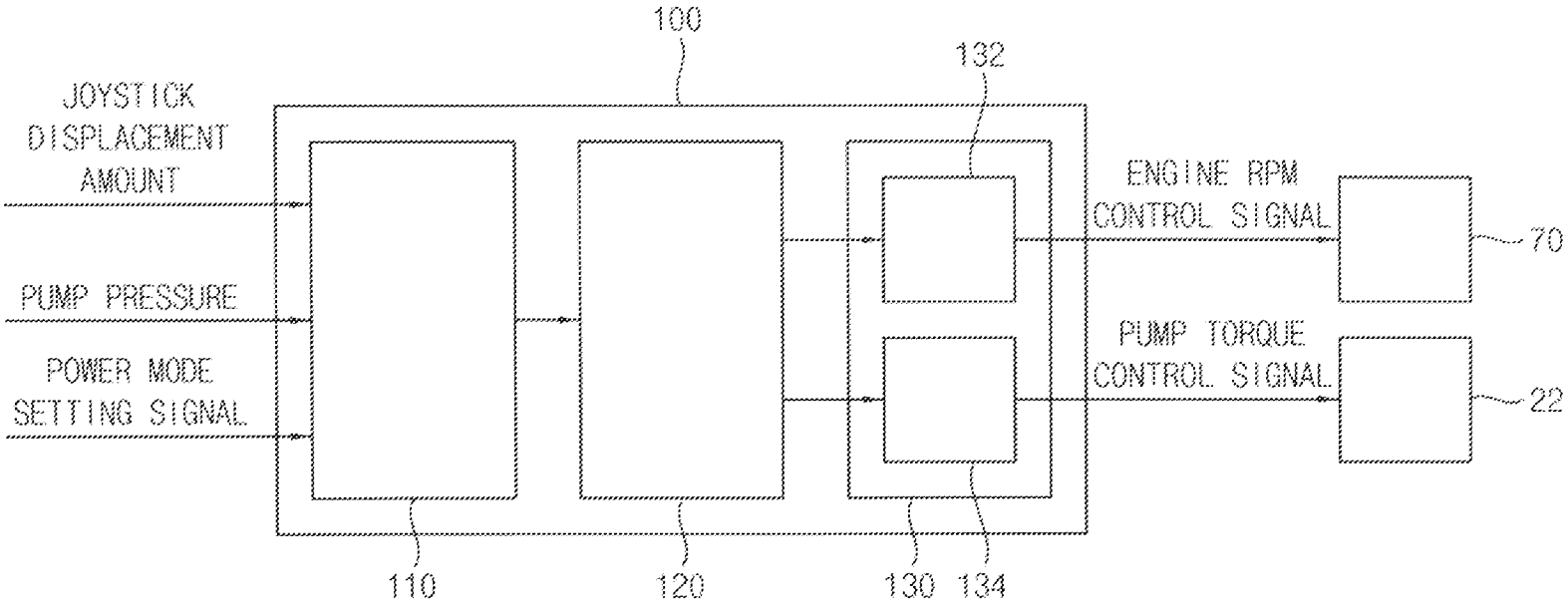
FIG. 2 is a block diagram illustrating a controller of the control system for the construction machinery in FIG. 1.
Figure 3:
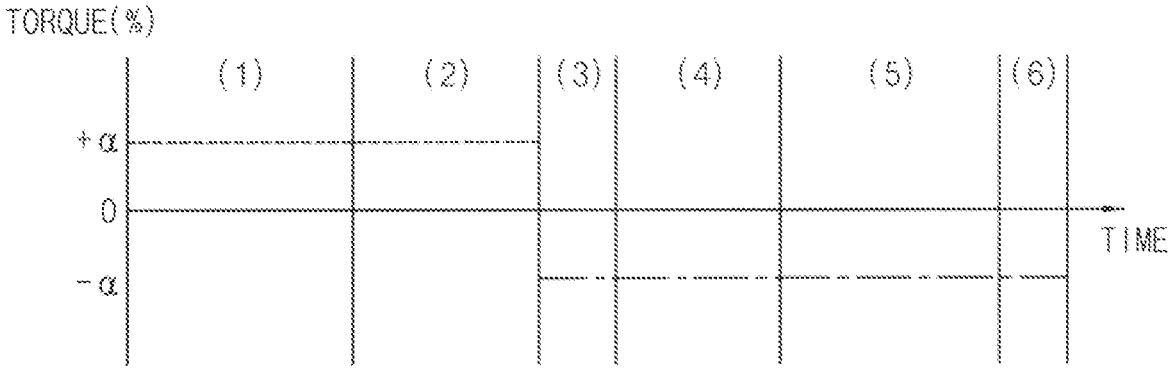
FIG. 3 is a graph illustrating a maximum absorbing torque of a hydraulic pump in a loading operation of an excavator in accordance with example embodiments.
Figure 4:
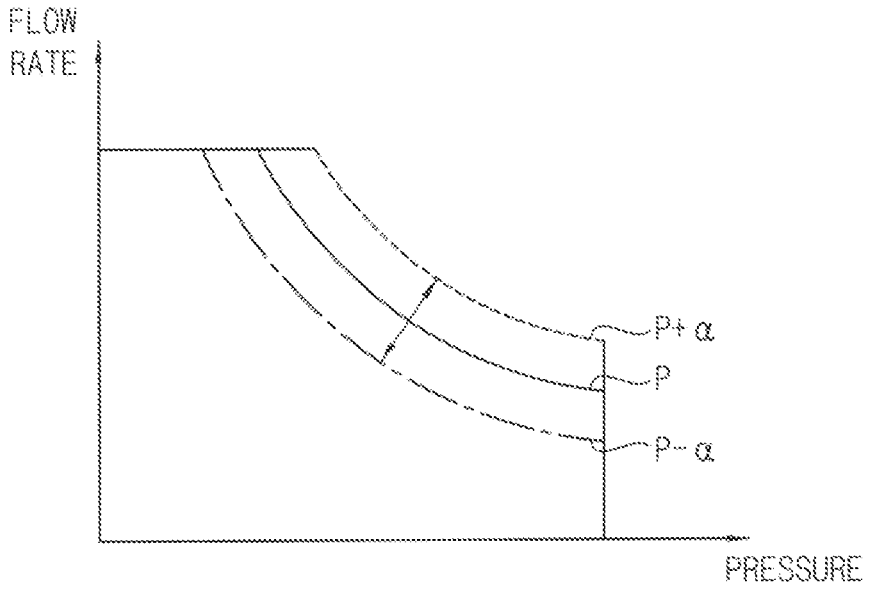
FIG. 4 is a graph illustrating a constant horse power diagram according to a torque control of the hydraulic pump in the loading operation in FIG. 3.
Figure 5:
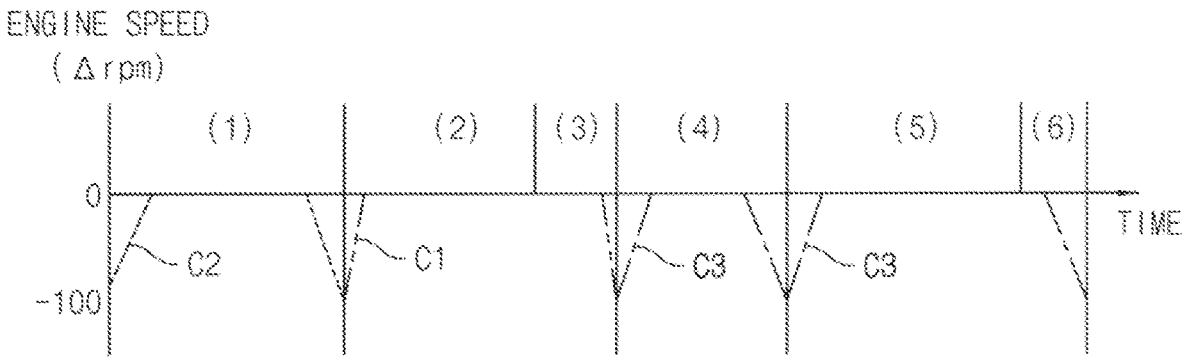
FIG. 5 is a graph illustrating an engine speed control in the loading operation in FIG. 3.
Figure 6:
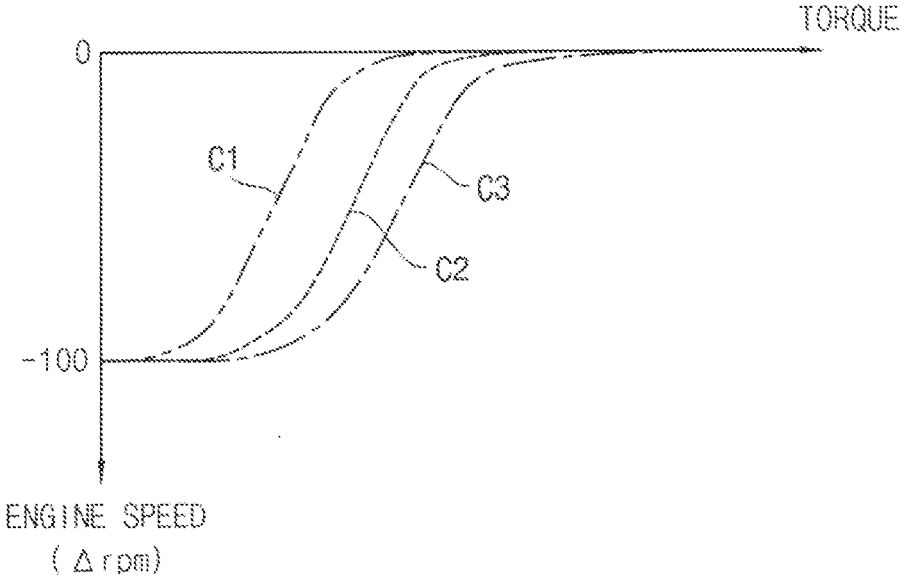
FIG. 6 is graphs illustrating engine RPM curves according to a percent torque in the engine speed control in FIG. 5.
Figure 7:
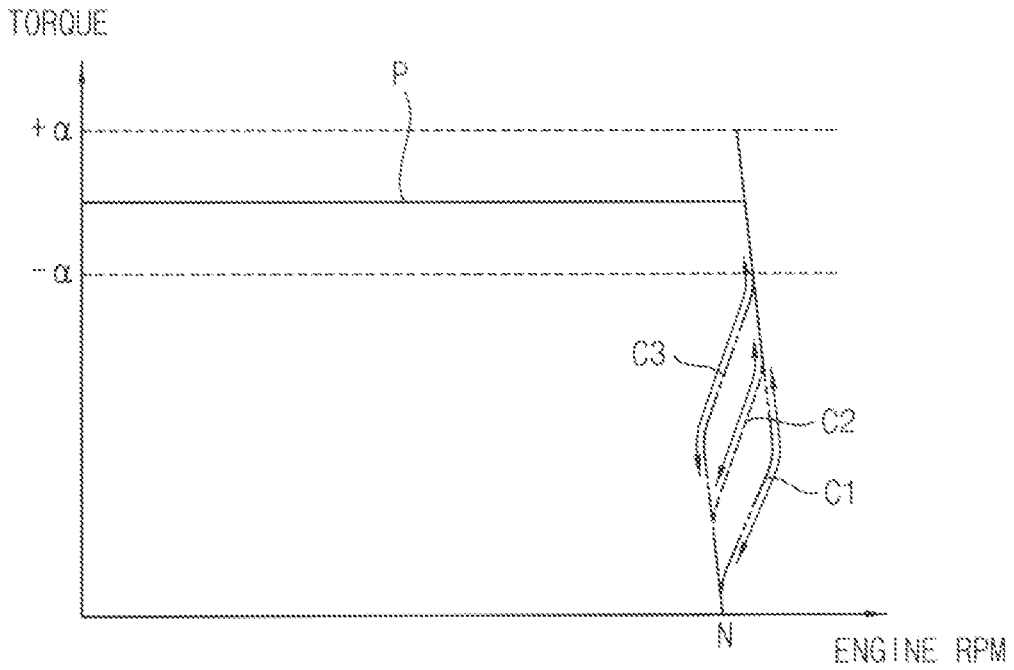
FIG. 7 is graphs illustrating a torque diagram of an engine in the loading operation in FIG. 3.

FIG. 1 is a hydraulic diagram illustrating a control system for construction machinery in accordance with example embodiments. FIG. 2 is a block diagram illustrating a controller of the control system for the construction machinery in FIG. 1. FIG. 3 is a graph illustrating a maximum absorbing torque of a hydraulic pump in a loading operation of an excavator in accordance with example embodiments. FIG. 4 is a graph illustrating a constant horse power diagram according to a torque control of the hydraulic pump in the loading operation in FIG. 3. FIG. 5 is a graph illustrating an engine speed control in the loading operation in FIG. 3. FIG. 6 is graphs illustrating engine RPM curves according to a percent torque in the engine speed control in FIG. 5. FIG. 7 is graphs illustrating a torque diagram of an engine in the loading operation in FIG. 3.

Referring to FIGS. 1 to 7, a control system for construction machinery may include an engine 10 as an internal combustion engine, at least one hydraulic pump 20 driven by the engine 10, a control valve 30 configured to control a flow direction of a hydraulic oil discharged from the hydraulic pump 20 to control operations of actuators 40, and a control device configured to control operations of the engine 10 and the hydraulic pump 20 according to a subordinate work pattern being performed by the construction machinery.

In example embodiments, the construction machinery may include an excavator, a wheel loader, a forklift, etc. Hereinafter, it will be explained that example embodiments may be applied to the excavator. However, it may not be limited thereto, and it may be understood that example embodiments may be applied to other construction machinery such as the wheel loader, the forklift, etc.

The construction machinery may include a lower travelling body, an upper swinging body mounted to be capable of swinging on the lower travelling body, and a cabin and a front working device installed in the upper swinging body. The front working device may include a boom, an arm and a bucket. The actuator 40 may include a boom cylinder installed between the boom and the upper swinging body to control a movement of the boom, an arm cylinder installed between the arm and the boom to control a movement of the arm, a bucket cylinder installed between the bucket and the arm to control a movement of the bucket, a swing motor installed between the upper swinging body and the lower travelling body to control the upper swing body, etc.

In example embodiments, the engine 10 may include a diesel engine as a driving source of the construction machinery such as an excavator. A torque control of the engine 10 may be performed by adjusting an amount of fuel injected into a cylinder of the engine 10. A fuel injection device 12 may be controlled to adjust the amount of the fuel based on an inputted control signal.

In example embodiments, the hydraulic pump 20 may be connected to an output axis of the engine 10, and as the output axis of the engine rotates, the hydraulic pump 20 may be driven to discharge the hydraulic oil. The hydraulic pump 20 may include a variable capacity hydraulic pump. A discharge flow rate of the hydraulic pump 20 may be determined by a swash plate angle. The angle of the swash plate of the hydraulic pump 20 may be adjusted by a pump regulator 22. An electronic proportional control valve may be provided in the pump regulator 22 to control the discharge flow rate of the hydraulic pump 20 based on the inputted control signal.

The hydraulic oil discharged from the hydraulic pump 20 may be supplied to the control valve 30, and if a specific spool of the control valve 30 is operated, the hydraulic oil may be supplied to the actuator 40 associated with the spool. For example, the control system for the construction machinery may include a main control valve (MCV) as an assembly including the control valve 30. The main control valve may be an electro-hydraulic main control valve including an electro proportional pressure reducing valve (EPPRV) which controls a pilot working oil supplied to the spool of the control valve according to an inputted electrical signal. Alternatively, the main control valve may include a hydraulic control valve controlled by a pilot pressure proportional to a manipulation signal.

An operator may manipulate a joystick, a pedal, etc. provided in a manipulation portion 50 to generate a manipulation signal proportional to a manipulation amount. For example, the manipulation portion 50 may generate a flow rate control signal (pilot pressure) via a pilot hydraulic oil according to the manipulation amount. The flow rate control signal may be supplied to the control valve 30.

In example embodiments, the control device of the construction machinery may include an engine control unit (ECU) 70, a controller 100, various sensors 200 and a setter 60, and may perform appropriate control according to a desired operation item by the operator.

A monitor panel serving as the setter 60 for selecting a desired power mode by an operator may be installed in a cabin. The power mode may represent an output ratio of the engine and the hydraulic pump, that is, an absorbing torque (limit torque) value of the hydraulic pump.

A mode, P+ mode, P mode, S mode, and E mode may be provided as the operation item of the power mode. The output ratio of the engine and the hydraulic pump, that is, an initial absorbing torque value of the hydraulic pump may be set according to the mode (P+ mode, P mode, S mode, and E mode) directly selected by the operator.

In example embodiments, the controller 100 may include a data receiver 110, a subordinate work determiner 120 and an output portion 130. The output portion 130 may include an engine control signal output portion 132 and a pump control signal output portion 134.

The data receiver 110 may receive signals necessary for determining a work pattern (subordinate work, sub work) currently being performed by the construction machinery. For example, the data receiver 110 may receive a joystick displacement amount as the manipulation signal from the manipulation unit 60. The data receiver 110 may receive a discharge pressure of the hydraulic pump 20 from a pump pressure sensor 200. The data receiver 110 may receive a power mode setting signal from the setter 60.

The subordinate work determiner 120 may determine a current subordinate work (sub work pattern) by using data from the data receiver 110. The subordinate work determiner 120 may normalize the data and perform a machine learning algorithm to determine the current subordinate work.

The output portion 130 may output control signals for controlling the engine 10 and the hydraulic pump 20 determined according to the current subordinate work. The engine control signal output portion 132 nay output an engine speed control signal determined according to the current subordinate work to the engine control unit 70, and the engine control unit 70 may control the fuel injection device 12 of the engine 10. The fuel injection device 12 may adjust the amount of the fuel based on the inputted engine speed control signal to control the engine speed (RPM). The pump control signal output portion 134 may output a hydraulic pump control signal determined according to the current subordinate work to the pump regulator 22. The pump regulator 22 may adjust the swash plate angle of the hydraulic pump 20 based on the inputted hydraulic pump control signal to control the discharge flow rate.

In particular, the subordinate work determiner 120 may divide the current subordinate work into a plurality of load areas, for example, a heavy load area, a middle load area, and a low load area according to an amount of load, and the output portion 130 may control an absorbing torque of the hydraulic pump 20 according to the load area and may control an increase/decrease rate (change rate) of the engine speed (engine speed change map) according to the torque of the engine 20.

As illustrated in FIGS. 3 and 4, the pump control signal output portion 134 may output a first pump control signal to the pump regulator 22 to have a first maximum absorbing torque that is increased by a first ratio from the initial absorbing torque value when the current subordinate work is in a high load area, and may output a second pump control signal to the pump regulator 22 to have a second maximum absorbing torque which is decreased by a second ratio from the initial absorbing torque value when the current subordinate work is in a low load area.

For example, when the excavator performs a loading operation, the loading operation may be divided into a digging work (1), a boom raising and swing work (2), a single swing work (3), a dump work (4), a single swing work (5) and a boom lowering work (6) as the subordinate works.

When the operator selects the P mode, the initial absorbing torque value P of the hydraulic pump 20 may be set. In this case, when the current subordinated work is the digging work (1), the boom raising and swinging work (2) or the pump control signal output portion 134 may output a first pump control signal to the pump regulator 22 to have a first absorbing torque value which is increased by a first ratio (a %) from the initial absorbing torque value P. When the current subordinated work is the single swing work (3, 5), the dump work (4) or the boom lowering work (6), the pump control signal output portion 134 may output a second pump control signal to the pump regulator 22 to have a second absorbing torque value which is decreased by a second ratio (−α %) from the initial absorbing torque value P.

As the first pump control signal and the second pump control signal are inputted to the pump regulator 22, the constant horsepower diagram of the hydraulic pump 20 may be changed. In case of the same external load (pressure), the discharge flow rate of the hydraulic pump 20 according to the first pump control signal may be controlled to be greater than the discharge flow rate of the hydraulic pump 20 according to the second pump control signal.

A torque value of a high power level may be applied to the digging work (1) and the boom raising and swing work (2), which are in the high load area, and a torque value of a low power level may be applied to the single swing work (3, 5), the dump work (4), and the boom lowering work (6), which are in the low load area.

Thus, productivity in the high load area may be improved, and torque in the low load area may be limited to suppress fuel consumption, which may be unnecessarily generated by pulsed disturbance. Further, the operator does not need to manually set the power mode every time, and may perform high productivity work of the high power mode even in the low power mode. Moreover, even for other operating situations that are not included in the 180 degree loading operation, it may be possible to recognize a work situation requiring a reduction in cycle time and change the torque limit value according to the corresponding situation.

As illustrated in FIGS. 5 and 6, the engine control signal output unit 132 may output a first engine speed control signal to the engine control unit 70 to have a first engine speed change rate in high-speed control (engine speed control in a high rpm range) when the current subordinate work requires a high working speed, may output a second engine speed control signal to the engine control unit 70 to have a second engine speed change rate less than the first engine speed change rate in high-speed control when the current subordinate work requires a relatively middle speed, and may output a third engine speed control signal to the engine control unit 70 to have a third engine speed change rate less than the second engine speed change rate in high-speed control when the current subordinate work requires a slow speed.

In FIG. 6, graph 1 (C1) shows an engine rpm profile according to a percent torque when the first engine speed change rate is provided in high-speed control of the engine 20, graph 2 (C2) shows an engine rpm profile according to a percent torque when the second engine speed change is provided in high-speed control of the engine 20, and graph 3(C3) shows an engine rpm profile according to a percent torque when the third engine speed change rate is provided in high-speed control of the engine 20.

An operator may manipulate a fuel dial to set a target engine speed. A high-speed control region in which an engine load and an engine torque are matched each other may be set according to the target engine speed. For example, by manipulating the fuel dial, any one of a first high speed control region including a maximum rated horsepower point and a second high speed control region defined in a relatively low speed section may be selected as the high-speed control region.

As illustrated in FIG. 7, when the first engine speed control signal is output to have the first engine speed change rate in the selected one high-speed control region, the engine speed may be controlled to increase along graph 1 (C1) from an initial operation ideal rotation speed (No) as the engine torque increases. When the second engine speed control signal is output to have the second engine speed change rate in the high-speed control region, the engine speed may be controlled to increase along graph 2 (C2) from the initial operation ideal rotation speed (No) as the engine torque increases. When the third engine speed control signal is output to have the third engine speed change rate in the high-speed control region, the engine speed may be controlled to increase along graph 3 (C3) from an initial operation ideal rotation speed (No) as the engine torque increases.

For example, in the boom rising and swinging work (2) and the single swinging work (3) which requires a fast cycle time, the first engine speed change rate (C1) in which rpm increases relatively fast may be applied to improve productivity. On the other hand, in the dump work (4), the single swing work (5) and the boom lowering work (6) in which rpm increases relatively slowly and it is necessary to maintain a relatively long low rpm in a low load area, the third engine speed change rate (C3) may be applied such that the work is performed for a relatively long time in a rpm region with good fuel economy (−100 rpm) to improve fuel efficiency. Thus, an optimized rpm profile curve may be applied for each subordinate work, to thereby improve fuel economy and productivity together.

Further, by switching the engine rpm profile curve (engine rotation speed change map) according to various detailed work types (subordinate work type), in a leveling work that requires a delicate work the rpm change rate may be minimized to thereby improve workability, and in an excavating or loading work that requires a fast work the rpm change rate may be maximized to quickly follow a required operation to thereby reduce working time and fuel economy.

Hereinafter, a method of controlling construction machinery using the control system in FIG. 1 will be explained.

Figure 8:
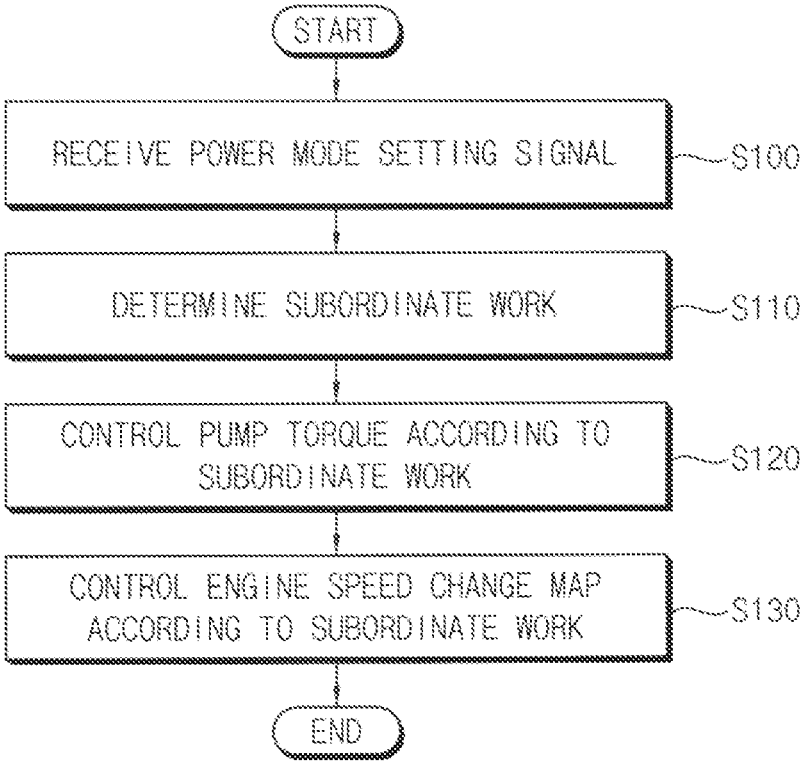
FIG. 8 is a flow chart illustrating a control method for construction machinery in accordance with example embodiments.

FIG. 8 is a flow chart illustrating a control method for construction machinery in accordance with example embodiments.

Referring to FIGS. 1, 2 and 8, a setting signal of a power mode may be received (S100), and a current subordinate work (detailed work) of the construction machinery nay be determined (S110).

In example embodiments, an operator may select a specific power mode through a setter 60, and a data receiver 110 of a controller 100 may receive the power mode setting signal from the setter 60.

For example, A mode, P+ mode, P mode, S mode, and E mode may be provided as an operation item of the power mode. An output ratio of an engine and a hydraulic pump, that is, an initial absorbing torque value of the hydraulic pump 20 may be determined according to the mode (P+ mode, P mode, S mode, and E mode) directly selected by the operator.

In example embodiments, signals necessary for determining a subordinate work (detailed work) currently being performed by the construction machinery may be received from various sensors, and a current subordinate work may be determined based thereon.

An operator may manipulate a manipulation portion 50 for a specific work, and the data receiver 110 of the controller 100 may receive manipulation signals for actuators 40, for example, a joystick displacement amount, a joystick pilot pressure, etc. from the manipulation portion 50. Additionally, the data receiver 110 may receive a discharge pressure of the hydraulic pump 20 from a pump pressure sensor 200.

A subordinate work determiner 120 of the controller 100 may determine a current subordinate work by using data from the data receiver 110. The subordinate work determiner 120 may normalize the data and perform a machine learning algorithm to determine the current subordinate work.

The subordinate work determiner 120 may divide the current subordinate work into a plurality of load areas, for example, a heavy load area, a middle load area, and a low load area according to an amount of load. Additionally, the subordinate work determiner 120 may divide the current subordinate work into a plurality of work speed regions, for example, a fast work speed region, a middle work speed region and a slow work speed region according to a work speed.

Then, a torque of the hydraulic pump 20 may be controlled according to the determined subordinate work (S120), and an engine rotation speed change map (engine speed change rate) in high-speed region may be controlled according to the determined subordinate work (S130).

In example embodiments, the hydraulic pump 20 may be controlled to have a maximum absorbing torque that is increased or decreased by a preset ratio from an initial absorbing torque value according to the load amount of the current subordinate work. Here, the initial absorbing torque value may be determined by the power mode selected by the operator.

In particular, a pump control signal output portion 134 of the controller 130 may output a first pump control signal to a pump regulator 22 to have a first maximum absorbing torque that is increased by a first ratio from the initial absorbing torque value when the current subordinate work is in a high load area. The pump regulator 22 may adjust a swash plate angle of the hydraulic pump 20 according to the first pump control signal such that the hydraulic pump 20 is controlled to have the first maximum absorption torque as the maximum absorbing torque.

The pump control signal output portion 134 of the controller 130 may output a second pump control signal to the pump regulator 22 to have a second maximum absorbing torque that is decreased by a second ratio from the initial absorbing torque value when the current subordinate work is in a low load area. The pump regulator 22 may adjust the swash plate angle of the hydraulic pump 20 according to the second pump control signal such that the hydraulic pump 20 is controlled to have the second maximum absorption torque as the maximum absorbing torque.

The pump control signal output portion 134 of the controller 130 may output a third pump control signal to the pump regulator 22 to have a third maximum absorbing torque that is less than the first maximum absorbing torque and greater than the second maximum absorbing torque, for example, the initial absorbing torque value when the current subordinate work is in a middle load area. The pump regulator 22 may adjust the swash plate angle of the hydraulic pump 20 according to the third pump control signal such that the hydraulic pump 20 is controlled to have the third maximum absorption torque as the maximum absorbing torque.

For example, when the excavator performs a loading operation, in case that the operator selects the P mode and the current subordinated work is the digging work (1) or the boom raising and swinging work (2), the maximum absorbing torque of the hydraulic pump 20 may be set to a value which is increased by a first ratio (a %) from an initial absorbing torque value P. In case that the current subordinated work is the single swing work (3, 5), the dump work (4) or the boom lowering work (6), the maximum absorbing torque of the hydraulic pump 20 may be set to a value which is decreased by a second ratio (−α %) from the initial absorbing torque value P.

In example embodiments, an engine speed change map (engine speed change rate) in high-speed control may be controlled according to a current working speed of the subordinate work. Here, an initial engine speed change rate in high-speed control may be determined by a fuel dial set value preset by an operator.

In particular, an engine control signal output portion 132 of the controller 130 may output a first engine speed control signal to an engine control unit 70 to have a first engine speed change rate greater than the initial engine speed change rate in high-speed control when the current subordinate work has a high working speed. The engine control unit 70 may control a fuel injection amount of a fuel injection device 12 according to the first engine speed control signal.

The engine control signal output portion 132 of the controller 130 may output a second engine speed control signal to the engine control unit 70 to have a second engine speed change rate less than the initial engine speed change rate in high-speed control when the current subordinate work has a slow working speed. The engine control unit 70 may control the fuel injection amount of the fuel injection device 12 according to the second engine speed control signal.

For example, when an excavator performs an loading operation, in case that a current subordinate work is the boom raising and swing work (2) or the single swing work (3), the engine speed change rate in high-speed control may be determined as a first engine speed change rate (C1) greater than the initial engine speed change rate. In case that the current subordinate work is the dump work (4), the single swing work (5) or the boom lowering work (6), the engine speed change rate in high-speed control may be determined as a second engine speed change rate (C3) less than the initial engine speed change rate. In case that the current subordinate work is the digging work (1), the engine speed change rate in high-speed control may be determined as a third engine speed change rate (C2) less than the first engine speed rate C1 and greater than the second engine speed change rate C3, for example, the initial engine speed change rate.

As mentioned above, the optimized maximum absorbing torque of the hydraulic pump 20 and the optimized engine speed change map (engine speed change rate) may be applied according to the current work situation (load amount, working speed). Thus, fuel economy and productivity may be improved together.

The foregoing is illustrative of example embodiments and is not to be construed as limiting thereof. Although a few example embodiments have been described, those skilled in the art will readily appreciate that many modifications are possible in example embodiments without materially departing from the novel teachings and advantages of the present invention. Accordingly, all such modifications are intended to be included within the scope of example embodiments as defined in the claims.

What is claimed is:

1. A control method for construction machinery, the control method comprising:

dividing an operation performed by the construction machinery into a plurality of subordinate works;

determining a current subordinate work currently performed by the construction machinery;

adjusting a maximum absorbing torque of a hydraulic pump according to the determined subordinate work; and adjusting an engine speed change map according to the determined subordinate work.

2. The control method of claim 1, wherein adjusting the maximum absorbing torque of the hydraulic pump comprises controlling the hydraulic pump to have a maximum absorbing torque that is increased or decreased by a preset ratio from an initial absorbing torque value according to a load amount of the current subordinate work.

3. The control method of claim 2, wherein the initial absorbing torque value is determined by a power mode selected by an operator.

4. The control method of claim 1, wherein adjusting the maximum absorbing torque of the hydraulic pump comprises controlling the hydraulic pump to have a first maximum absorbing torque that is increased by a first ratio from the initial absorbing torque value when the current subordinate work is in a high load area; and controlling the hydraulic pump to have a second maximum absorbing torque that is decreased by a second ratio from the initial absorbing torque value when the current subordinate work is in a low load area.

5. The control method of claim 4, wherein adjusting the maximum absorbing torque of the hydraulic pump further comprises controlling to have a third maximum absorbing torque that is less than the first maximum absorbing torque value and greater than the second maximum absorbing torque value when the current subordinate work is in a middle load area.

6. The control method of claim 1, wherein adjusting the engine speed change map comprises controlling an engine to have an engine speed change rate that is increased or decreased by a preset ratio from an initial engine speed change rate in high-speed control according to a required working speed of the current subordinate work.

7. The control method of claim 6, wherein the initial engine speed change rate is determined by a fuel dial set value preset by an operator.

8. The control method of claim 1, wherein adjusting the engine speed change map comprises controlling the engine to have a first engine speed change rate in high-speed control when the current subordinate work has a first required working speed; and controlling the engine to have a second engine speed change rate less than the first engine speed change rate in high-speed control when the current subordinate work has a second required working speed less than the first required working speed.

9. A control system for construction machinery, the construction machinery including an engine, a hydraulic pump driven by the engine and a control valve configured to control a flow direction of a hydraulic oil discharged from the hydraulic pump to control operations of actuators, the control system comprising:

a controller configured to determine a current subordinate work of the construction machinery and output a pump control signal and an engine control signal according to the determined current subordinate work;

a pump regulator configured to adjust a swash plate angle of the hydraulic pump to have a maximum absorbing torque corresponding to the pump control signal; and an engine control unit configured to adjust an engine rpm to have an engine speed change map corresponding to the engine control signal.

10. The control system of claim 9, wherein the controller controls the swash plate angle of the hydraulic pump to have the maximum absorbing torque that is increased or decreased by a preset ratio from an initial absorbing torque value of the hydraulic pump according to a load amount of the current subordinate work.

11. The control system of claim 9, wherein the initial absorbing torque value is determined by a power mode selected by an operator.

12. The control system of claim 9, wherein the controller outputs a first pump control signal to have a first maximum absorbing torque that is increased by a first ratio from the initial absorbing torque value when the current subordinate work is in a high load area, and the controller outputs a second pump control signal to have a second maximum absorbing torque that is decreased by a second ratio from the initial absorbing torque value when the current subordinate work is in a low load area.

13. The control system of claim 12, wherein the controller outputs a third pump control signal to have a third maximum absorbing torque that is less than the first maximum absorbing torque value and greater than the second maximum absorbing torque value when the current subordinate work is in a middle load area.

14. The control system of claim 9, wherein the controller controls the engine to have an engine speed change rate that is increased or decreased by a preset ratio from an initial engine speed change rate in high-speed control according to a required working speed of the current subordinate work.

15. The control system of claim 14, wherein the initial engine speed change rate is determined by a fuel dial set value preset by an operator.

16. The control system of claim 9, wherein the controller outputs a first engine control signal to have a first engine speed change rate in high-speed control when the current subordinate work has a first required working speed, and the controller outputs a second engine control signal to have a second engine speed change rate less than the first engine speed change rate in high-speed control when the current subordinate work has a second required working speed less than the first required working speed.

* * * * *